US005868147A

United States Patent [19]

Davidson

[11] Patent Number: 5,868,147

[45] Date of Patent: Feb. 9, 1999

[54] HAIR CURLER SYSTEM HAVING A STRIP OF HAIR FOR WRAPPING A CYLINDRICAL ROLLER

[76] Inventor: Carolyn C. Davidson, 5445 Steeplechase La., Westerville, Ohio 43081

[21] Appl. No.: 965,093

[22] Filed: Nov. 6, 1997

[51] Int. Cl.[6] ..... A45D 6/00

[52] U.S. Cl. ..... 132/251; 132/53; 132/275

[58] Field of Search ..... 132/53, 54, 55, 132/245, 251, 252, 262, 264, 275; 428/107, 114, 113

[56] References Cited

U.S. PATENT DOCUMENTS

| | | | |
|---|---|---|---|
| 1,187,244 | 6/1916 | Bianchi | 132/53 |
| 2,651,310 | 9/1953 | Selson | 132/53 |
| 2,972,994 | 2/1961 | Ferens | 132/245 |
| 3,073,318 | 1/1963 | Catania | 132/251 |
| 3,267,642 | 8/1966 | Mestral | 132/262 |
| 3,294,099 | 12/1966 | Warthen, et al. | 132/262 |
| 3,309,562 | 3/1967 | Corbett et al. | 132/55 |
| 3,616,804 | 11/1971 | Simoneaux | 132/265 |
| 3,843,990 | 10/1974 | Lardenois | 132/120 |
| 3,909,868 | 10/1975 | Noques | 15/27 |
| 4,406,296 | 9/1983 | Wexler et al. | 132/53 |
| 5,538,021 | 7/1996 | Kim | 132/245 |

FOREIGN PATENT DOCUMENTS

| | | | |
|---|---|---|---|
| 2250900 | 4/1974 | Germany | 132/251 |

*Primary Examiner*—Todd E. Manahan
*Assistant Examiner*—Eduardo C. Robert

[57] ABSTRACT

A new hair curler system for providing a woman a more discreet way of wearing curlers in her hair. The inventive device includes a strip of hair adapted for wrappedly engaging a cylindrical hair roller. The strip of hair has a generally rectangular configuration defined by opposed long side edges and opposed short end edges. A top surface of an upper end edge has a first hook and loop strip disposed thereon. A bottom surface of a lower end edge has a second hook and loop strip disposed thereon. The upper end edge is positionable on the cylindrical hair roller whereby the strip of hair is wrapped around the cylindrical hair roller and the second hook and loop strip is mated with the first hook and loop strip.

2 Claims, 1 Drawing Sheet

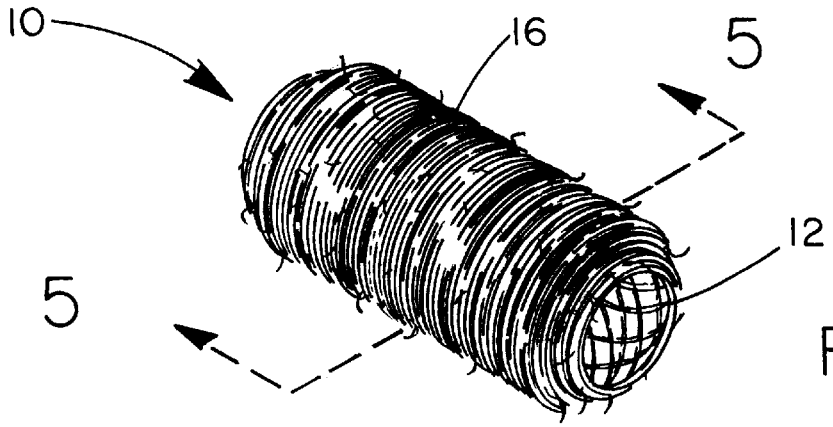
FIG. 1
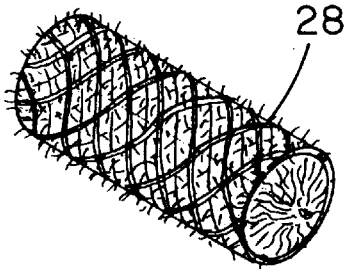
FIG. 3
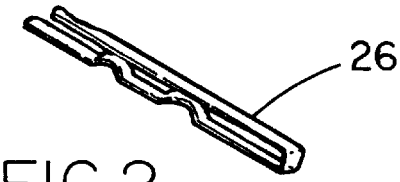
FIG. 2
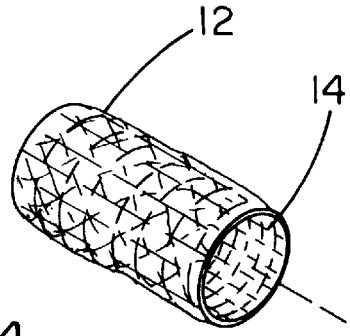
FIG. 4
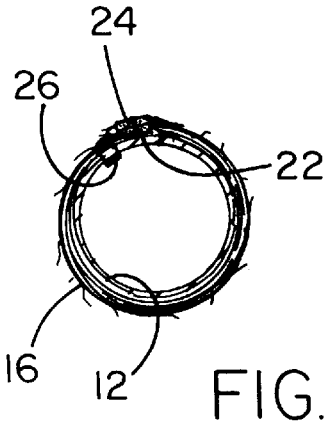
FIG. 5
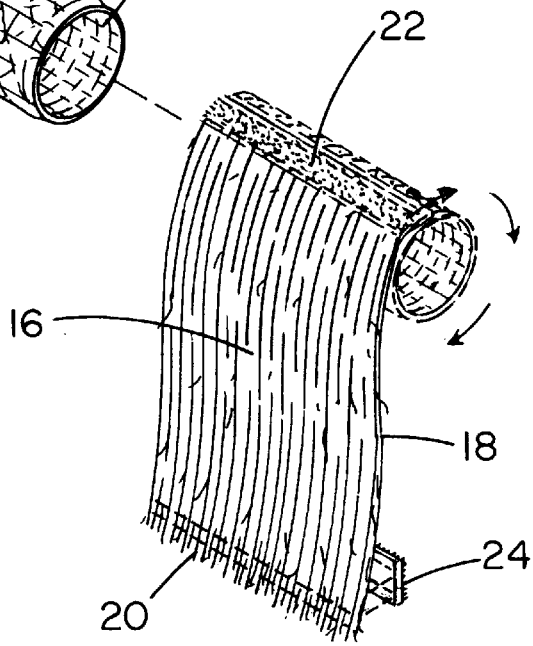

HAIR CURLER SYSTEM HAVING A STRIP OF HAIR FOR WRAPPING A CYLINDRICAL ROLLER

BACKGROUND OF THE INVENTION

1. Field of the Invention

The present invention relates to hair rollers and more particularly pertains to a new hair curler system for providing a woman a more discreet way of wearing curlers in her hair.

2. Description of the Prior Art

The use of hair rollers is known in the prior art. More specifically, hair rollers heretofore devised and utilized are known to consist basically of familiar, expected and obvious structural configurations, notwithstanding the myriad of designs encompassed by the crowded prior art which have been developed for the fulfillment of countless objectives and requirements.

Known prior art hair rollers include U.S. Pat. No. 5,186,187 to Roberts; U.S. Pat. No. 5,000,201 to Barradas; U.S. Pat. No. 4,310,008 to Lalli; U.S. Pat. No. 3,960,157 to Andrews et al.; U.S. Pat. No. 4,431,012 to Brenn Albertoni; and U.S. Pat. No. 4,056,109 to Takai.

While these devices fulfill their respective, particular objectives and requirements, the aforementioned patents do not disclose a new hair curler system. The inventive device includes a strip of hair adapted for wrappedly engaging a cylindrical hair roller. The strip of hair has a generally rectangular configuration defined by opposed long side edges and opposed short end edges. A top surface of an upper end edge has a first hook and loop strip disposed thereon. A bottom surface of a lower end edge has a second hook and loop strip disposed thereon. The upper end edge is positionable on the cylindrical hair roller whereby the strip of hair is wrapped around the cylindrical hair roller and the second hook and loop strip is mated with the first hook and loop strip.

In these respects, the hair curler system according to the present invention substantially departs from the conventional concepts and designs of the prior art, and in so doing provides an apparatus primarily developed for the purpose of providing a woman a more discreet way of wearing curlers in her hair.

SUMMARY OF THE INVENTION

In view of the foregoing disadvantages inherent in the known types of hair rollers now present in the prior art, the present invention provides a new hair curler system construction wherein the same can be utilized for providing a woman a more discreet way of wearing curlers in her hair.

The general purpose of the present invention, which will be described subsequently in greater detail, is to provide a new hair curler system apparatus and method which has many of the advantages of the hair rollers mentioned heretofore and many novel features that result in a new hair curler system which is not anticipated, rendered obvious, suggested, or even implied by any of the prior art hair rollers, either alone or in any combination thereof.

To attain this, the present invention generally comprises a cylindrical roller portion having open end portions. A strip of hair is adapted for wrappedly engaging the cylindrical roller portion. The strip of hair has a generally rectangular configuration defined by opposed long side edges and opposed short end edges. A top surface of an upper end edge has a first hook and loop strip disposed thereon. A bottom surface of a lower end edge has a second hook and loop strip disposed thereon. The upper end edge is positionable on the cylindrical roller portion whereby the strip of hair is wrapped around the cylindrical roller portion and the second hook and loop strip is mated with the first hook and loop strip. A hair clip is adapted for coupling a wearer's hair with the strip of hair when rolled on the cylindrical roller portion. A cylindrical roller brush portion is provided having hair disposed thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair curler system apparatus and method which has many of the advantages of the hair rollers mentioned heretofore and many novel features that result in a new hair curler system which is not anticipated, rendered obvious, suggested, or even implied by any of the prior art hair rollers, either alone or in any combination thereof.

It is another object of the present invention to provide a new hair curler system which may be easily and efficiently manufactured and marketed.

It is a further object of the present invention to provide a new hair curler system which is of a durable and reliable construction.

An even further object of the present invention is to provide a new hair curler system which is susceptible of a low cost of manufacture with regard to both materials and labor, and which accordingly is then susceptible of low prices of sale to the consuming public, thereby making such hair curler system economically available to the buying public.

Still yet another object of the present invention is to provide a new hair curler system which provides in the apparatuses and methods of the prior art some of the advantages thereof, while simultaneously overcoming some of the disadvantages normally associated therewith.

Still another object of the present invention is to provide a new hair curler system for providing a woman a more discreet way of wearing curlers in her hair.

Yet another object of the present invention is to provide a new hair curler system which includes a strip of hair adapted for wrappedly engaging a cylindrical hair roller. The strip of hair has a generally rectangular configuration defined by opposed long side edges and opposed short end edges. A top surface of an upper end edge has a first hook and loop strip disposed thereon. A bottom surface of a lower end edge has a second hook and loop strip disposed thereon. The upper end edge is positionable on the cylindrical hair roller whereby the strip of hair is wrapped around the cylindrical hair roller and the second hook and loop strip is mated with the first hook and loop strip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new hair curler system according to the present invention.

FIG. 2 is a perspective view of a clip of the present invention.

FIG. 3 is a perspective view of a brush roller of the present invention.

FIG. 4 is an exploded perspective view of the present invention.

FIG. 5 is a cross-sectional view of the present invention as taken along line 5—5 of FIG. 1.

DESCRIPTION OF THE PREFERRED EMBODIMENT

With reference now to the drawings, and in particular to FIGS. 1 through 5 thereof, a new hair curler system embodying the principles and concepts of the present invention and generally designated by the reference numeral 10 will be described.

As best illustrated in FIGS. 1 through 5, the hair curler system 10 comprises a cylindrical roller portion 12 having open end portions 14.

A strip of hair 16 is adapted for wrappedly engaging the cylindrical roller portion 12. The strip of hair 16 has a generally rectangular configuration defined by opposed long side edges 18 and opposed short end edges 20. A top surface of an upper end edge 18 has a first hook and loop strip 22 disposed thereon. A bottom surface of a lower end edge 18 has a second hook and loop strip 24 disposed thereon. The upper end edge 18 is positionable on the cylindrical roller portion 12 whereby the strip of hair 16 is wrapped around the cylindrical roller portion 12 and the second hook and loop strip 24 is mated with the first hook and loop strip 22.

A hair clip 26 is adapted for coupling a wearer's hair with the strip of hair 16 when rolled on the cylindrical roller portion 12.

Alternately, a cylindrical roller portion 12 could be produced with human hair incorporated into the roller.

In use, the present invention would allow a woman have curlers discreetly worn outside the house. The cylindrical roller portion 12 is preferably fabricated of plastic with the strip of hair 16 produced from synthetic or authentic hair. The user would simply wrap a portion of her hair around the roller portion 12 after the strip of hair 16 is in place and secure it in place utilizing the clip 26. The strip of hair 16 would blend in with the user's original hair to allow a woman to wear curlers outside of the home.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair curler system for providing a woman a more discreet way of wearing curlers in her hair comprising, in combination:

a cylindrical roller portion having open end portions;

a strip of hair for wrappedly engaging the cylindrical roller portion, the strip of hair having a generally rectangular configuration defined by two sets of opposed perimeter edges, a top surface of one perimeter edge having a first hook and loop strip disposed along a full length thereof, a bottom surface of a second perimeter edge having a second hook and loop strip disposed along a full length thereof the second perimeter edge being opposite the first perimeter edge for engaging the first hook and loop strip to the second hook and loop strip such that the strip of hair is coupled around the cylindrical roller;

a hair clip adapted for coupling a wearer's hair around the strip of hair coupled to the cylindrical roller when the wearer's hair is wrapped around the material.

2. A hair curler system for providing a woman a more discreet way of wearing curlers in her hair comprising, in combination:

a cylindrical roller portion having open end portions;

a strip of hair for wrappedly engaging the cylindrical hair roller, the strip of hair having a generally rectangular configuration defined by two sets of opposed perimeter edges, a top surface of one perimeter edge having a first hook and loop strip disposed along a full length thereof, a bottom surface of a second perimeter edge having a second hook and loop strip disposed along a full length thereof, the second perimeter edge being opposite the first perimeter edge for engaging the first hook and loop strip to the second hook and loop strip such that the material is coupled around the cylindrical roller.

* * * * *